United States Patent [19]

Cecala et al.

[11] Patent Number: 4,530,112

[45] Date of Patent: Jul. 23, 1985

[54] SELF-ADJUSTING CAP LAMP BRACKET

[75] Inventors: Andrew B. Cecala, Baldwin; Jon C. Volkwein, Canonsburg, both of Pa.

[73] Assignee: The United States of America as represented by the Secretary of Interior, Washington, D.C.

[21] Appl. No.: 488,480

[22] Filed: Apr. 25, 1983

[51] Int. Cl.[3] ..... A42B 1/24

[52] U.S. Cl. ..... 2/209.2; 2/422; 2/8; 362/105

[58] Field of Search ..... 2/209.2, 424, 422, 5, 2/6, 8, 9, 10; 362/105, 106, 107

[56] References Cited

U.S. PATENT DOCUMENTS

| | | | |
|---|---|---|---|
| 1,715,148 | 5/1929 | Simmons | 2/209.2 |
| 2,649,019 | 8/1953 | Hartline et al. | 2/8 X |
| 4,156,942 | 6/1979 | Isfeld | 2/209.2 X |
| 4,193,132 | 3/1980 | Peterson | 2/8 |
| 4,199,802 | 4/1980 | Malm | 362/105 X |
| 4,274,128 | 6/1981 | Malis | 362/105 |
| 4,298,913 | 11/1981 | Lozar | 362/105 X |
| 4,332,004 | 5/1982 | Slaughter | 362/105 |

*Primary Examiner*—Peter Nerbun

*Attorney, Agent, or Firm*—Thomas Zack; E. Philip Koltos

[57] ABSTRACT

A combined headpiece, light source, and protective face shield. The orientation of the emitted light beam from the light source remains the same whether the face shield is in a down protective position or a raised unprotective position for the user's face. This allows the user to use both hands while at the same time having the beam directed forward to illuminate the environment. A hinge and bracket assembly joining the face shield to the light source allow the source to maintain its desired orientation. A flexible power supply lamp cord rigidly attached to the headpiece supplies a retaining force to the lamp and its attached hinged bracket to act to maintain it in its moved position. Although this invention has application to many different types of end uses, its preferred embodiment was primarily designed and constructed for use by miner's underground.

4 Claims, 3 Drawing Figures

SELF-ADJUSTING CAP LAMP BRACKET

BACKGROUND OF THE INVENTION

This disclosure relates to a combined headpiece with a protective face shield and an automatically adjusting light source.

DESCRIPTION OF THE PRIOR ART

In many hostile environments, face shields are mounted on headpieces of users, and at the same time, a light source is employed with the headpiece. Breathable gas may be supplied to the user at the same time. One of the best examples of such a use is disclosed in our preferred embodiment wherein a miner's lamp cap has an adjustable face shield. Normally, in the prior art, if the miner wishes to speak, eat, wear any type of auxiliary breathing device, etc., the face shield would be raised and the lamp rigidly attached on the cap would move, as a consequence, having its beam directed upwardly towards the mine roof. Should the use of both hands be required, as in an emergency, this misdirected lamp beam could cause severe problems. Essentially, our invention seeks to overcome these prior art problems by allowing a user to not only raise the face shield and have both hands free, but also have the lamp beam automatically directed to a forward facing direction at the same time.

The prior art patent literature is replete with headgear combined with lamps attached or mounted on the headgear. Besides miners, physicians and surgeons, firemen, and motorcyclists, any users wishing to illuminate their environment could have used such headpieces. Examples are disclosed in U.S. Pat. Nos. 3,745,993 (Feinbloom), 4,090,232 (Golden), 4,199,802 (Malm), and 4,234,910 (Price). In the Feinbloom and Golden inventions, a pivot attaching the lamp is provided to allow the lamp's beam direction to be manually adjusted by the user. Price allows the direction of the emitted light beam to be changed by the user as the user's head is moved. The Malm invention uses a relatively complex pendulum/cable linkage to direct the beam from the light source in the same direction as the user's head (see column 3, lines 3–35). This latter invention, although it does not employ a face shield, is functionally the closest known prior art. However, our invention is much less complex in structure than Malm, and also employs a face shield interconnected to the light source.

SUMMARY OF THE INVENTION

A combined headpiece, lamp, and a face shield. As the face shield is rotated about a fixed axis on the headpiece, a counterrotation movement is imparted through a hinged bracket causing the lamp beam to remain directed in the same direction as it was before the shield was rotated. This counterrotation movement is automatically imparted to the lamp by a tensioned device attached to the lamp which connects to the face shield.

DESCRIPTION OF THE PREFERRED EMBODIMENTS

Figure 1:
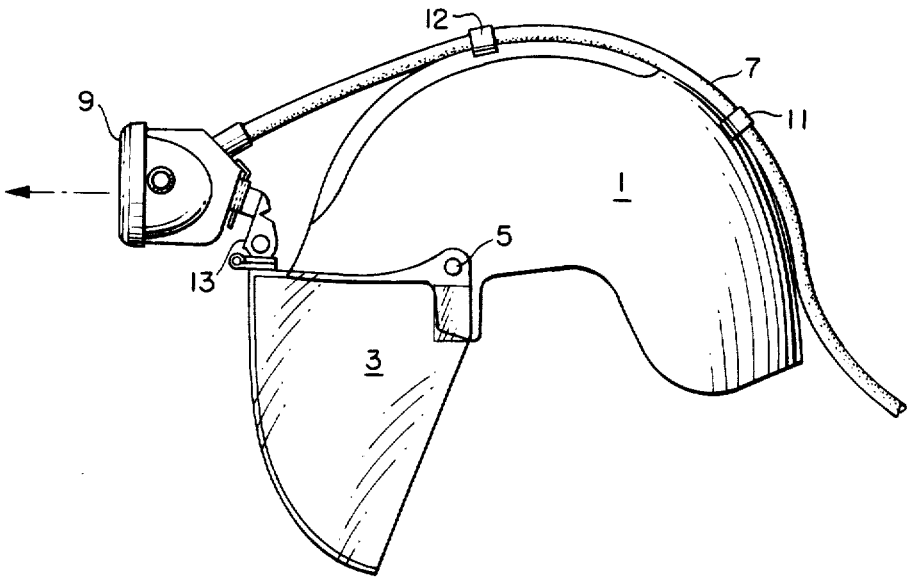
FIG. 1 shows a side view of the cap with its lamp when the face shield is in a down face protecting position.

The FIG. 1 preferred embodiment shows a more or less typical miner's safety headpiece, cap, hat, or helmet 1 with a safety shield 3. This shield is attached to the hat by two safety pins 5 (only one shown). In turn, these pins—one on each side of the hat above the user's eyes—act as pivot points to allow the shield to be manually raised or lowered by the miner. An electrical lamp cord 7 connects the lamp 9 to a self-contained (or battery) power source (not shown) carried by the user on his or her belt. Nylon, plastic or other type clips 11 and 12 firmly fix the cord to the upper surface of the hat. The lamp cord is constructed of a material which allows it to flex and at the same time is strong enough to exert a force when compressed. The cord is also slightly tensioned between its clips and the lamp, thereby transmitting some force to the lamp which biases it to remain in the position of FIG. 1. When the face shield is in a down or face protecting position, the lamp's emitted light beam is directed forwardly, as shown by the arrow in FIG. 1, in the same direction the user would normally be looking. In this situation, the lamp bracket 13 would be in a closed position and interconnecting the lamp to the upper middle edge of the face safety shield.

Figure 2:
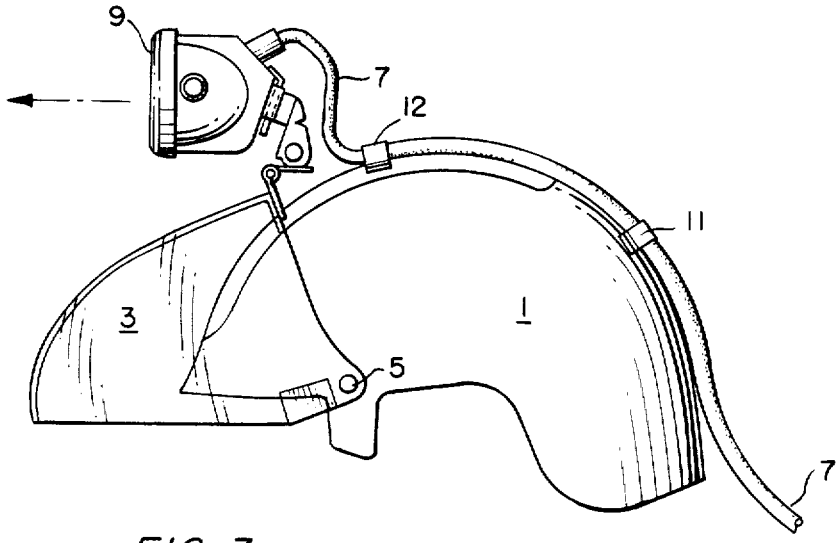
FIG. 2 depicts the same device as in FIG. 1 with the face shield raised.

Many circumstances exist wherein the user may desire or be required to raise the safety shield to the up position as depicted in FIG. 2. Besides the apparent times the user may desire to raise the shield—to eat, speak, or talk without obstruction—there are times the shield must be raised. For example, if the user were a miner and a self-rescue portable breathing unit were required to be used. Whatever the reason, it may be desirable or critical to keep the light beam directed in the same initial FIG. 1 direction rather than allowing it to shine upwardly.

Figure 3:
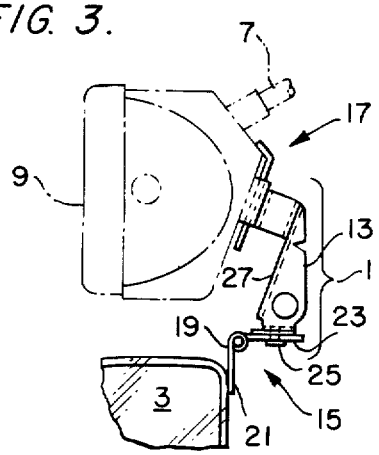
FIG. 3 is an enlarged side view of the FIG. 2 lamp bracket and immediate adjoining lamp and shield portions.

The mechanism which allows the lamp to retain its original orientation after the shield is raised is illustrated in the enlarged side view of FIG. 3. It is made up of the aforesaid lamp bracket assembly 13. This assembly has a hinge 15 connected on one half to the top of the face shield and connected on the other half to the main body of the lamp bracket 27. A pivot pin 19 interconnects the two halves 21 and 23 of the hinge to provide for its pivotal movement thereabout as the shield is moved. Above the upper hinge half 23, a rivet or other type of fastner rigidly joins the hinge to the main body 27 of the lamp bracket. The cap lamp is then attached to the lamp bracket assembly 13 using the lamp holding clip 17.

When the face shield is moved by a user from the FIG. 1 to FIG. 2 position, the shield rotates about pins 5 and the lamp automatically counterrotates about pivot 19 the same degree of angular displacement. Thus, if shield is moved ninety degrees (90°) clockwise, the lamp is rotated a like 90° angular displacement counterclockwise. Initially, when the face shield is in a down user protective position, the two hinge halves 21 and 23 are parallel and abutting each other as in FIG. 1. When the shield is manually moved about its pivot, the force supplied by the now more compressed cord 7 rigidly fixed to the hat acts to force the hinge into its opened—about 90° between the plates—FIG. 2 position. If the lamp were to strike a low roof obstruction, the opened hinge would give and then return to its original position without transferring the shock directly to the headpiece or user. Conversely, when the shield is down, as in FIG. 1, the cap lamp is retained in position (closed hinge) by the tension created by the lamp cord.

Variations as to the details of the disclosed preferred embodiment are possible. Also, the type of end user or environment is not necessarily to be limited to miners in underground mines. None, however, should be used to change the scope and spirit of our invention which is to be limited only by the claims that follow.

We claim:

1. A combined lamp and headpiece with a face shield attached thereto comprising:

a headpiece to be worn on the head of a user with a light beam emitting source connected thereto, said source being connected to the headpiece by a power transmitting conduit fixed to the headpiece and means for supplying a retaining force to the source;

a protective face shield mounted to said headpiece and movable with respect to it along a direction having a first horizontal component and a vertical component from a first face protecting position to a second upper face exposed position; and pivot means interconnecting the light emitting source to the face shield for causing the automatic movement of said source in a direction having a second horizontal component and a vertical component, said first horizontal component being opposite in direction to said second horizontal component when the shield is moved from its first to its second position whereby the orientation of the direction of the light beam emitting source remains substantially the same as it was before the shield was moved.

2. The combination of claim 1 wherein said means interconnecting the light source and face shield comprises a lamp bracket with a hinge assembly, said light source being fixed to the bracket and said hinge assembly, said hinge allowing the pivotal movement of the light source with respect to the shield.

3. The combination of claim 2 wherein said hinge assembly comprises two flat hinged plates connected together by a pivot member, one of said plates being connected to the upper portion of said shield.

4. The combination of claim 3 wherein the other of said hinge plates is connected to the lamp bracket, said plates abutting each other when the face shield is in its first down user protective position, and being approximately at a right angle with respect to each other when the face shield is raised to its uppermost second face nonprotective position.

* * * * *